US005864096A

United States Patent [19]

Williams et al.

[11] Patent Number: 5,864,096

[45] Date of Patent: Jan. 26, 1999

[54] WILDLIFE GUARD FOR ELECTRICAL POWER DISTRIBUTION AND SUBSTATION FACILITIES

[75] Inventors: R. Brent Williams; Richard K. Murphy, both of Houston, Tex.

[73] Assignee: Houston Industries Incorporated, Houston, Tex.

[21] Appl. No.: 907,829

[22] Filed: Aug. 14, 1997

[51] Int. Cl.[6] ..... H01B 17/00

[52] U.S. Cl. ..... 174/139; 174/151; 52/101; 49/58

[58] Field of Search ..... 174/139, 151, 174/17 GF, 31 R, 162, 137 R, 136, 138 R, 161, 138 E, 5 R, 140 R, 3, 141 R, 135, 144; 361/604, 618, 232; 49/58, 59; 52/101

[56] References Cited

U.S. PATENT DOCUMENTS

| | | | |
|---|---|---|---|
| 3,639,678 | 2/1972 | Muschong . | |
| 3,639,681 | 2/1972 | Ettlinger . | |
| 4,053,707 | 10/1977 | Ely et al. | 174/209 |
| 4,201,883 | 5/1980 | Shepherd . | |
| 4,637,164 | 1/1987 | Brown . | |
| 4,731,507 | 3/1988 | Torimoto et al. | 174/139 |
| 4,845,307 | 7/1989 | Cumming, et al. . | |
| 5,023,406 | 6/1991 | Thornley | 174/209 |
| 5,293,835 | 3/1994 | Shagoury | 119/57.9 |
| 5,446,242 | 8/1995 | Barrett | 174/140 R |
| 5,648,641 | 7/1997 | Gurthrie | 174/139 |

FOREIGN PATENT DOCUMENTS

| | | | |
|---|---|---|---|
| 396294 | 8/1933 | United Kingdom | 174/139 |

OTHER PUBLICATIONS

*Animal Caused Outages*, Figures 8.1, 8.16, and 8.20, prepared by Southern Engineering Company Rural Electric Research, National Rural Electric Cooperative Association. Copyright 1996.

*Primary Examiner*—Kristine Kincaid
*Assistant Examiner*—Dhiru R. Patel
*Attorney, Agent, or Firm*—Pravel, Hewitt & Kimball

[57] ABSTRACT

A wildlife guard for electrical power distribution equipment is easily and safely installed by hot stick without power interruption. The guard includes a disc of electrically insulating material having a hollow center for mounting an insulator, a cutaway tab-and-ring section of the disc for adapting the disc to a plurality of insulator core sizes, and at least one installation grip section of the disc for receiving a gripping portion of hot stick. The guard also may include an adaptation section of the disc for adapting the disc to also protect an adjacent or physically associated insulator. In addition, a guard may include a comb or toothed inlet guide section for ease of installation and for subsequently holding the disc in place around an insulator. The guard also eliminates the need for a service interruption during installation and protects the crew members in the installation area by providing for installation with insulated manipulator sticks.

30 Claims, 5 Drawing Sheets

WILDLIFE GUARD FOR ELECTRICAL POWER DISTRIBUTION AND SUBSTATION FACILITIES

BACKGROUND OF THE INVENTION

1. Field of the Invention

The present invention relates to wildlife guards for protection of electrical power distribution and substation equipment.

2. Description of the Related Art

Distribution and substation equipment used to supply electrical power have used wildlife protection to prevent wildlife from simultaneously contacting energized and grounded surfaces. If such contact occurred, short circuits and consequent power outages frequently were the result. The wildlife protection was typically applied to an equipment bushing or lightning arrester of the distribution or substation equipment. So far as is known, existing types of wildlife guards have required separate guards for both the bushing and the arrester. For adequate protection, a number of presently available wildlife guards have also required an insulated or covered wire between the bushing and arrester.

Available wildlife guards have posed problems regarding their installation. Some of the present wildlife guard designs have required service interruptions so that the guard could be installed safely by hand on deenergized equipment. These types of wildlife guards were of a unitary, one-piece structure and have required service interruption so that a conductor known in the art as a "stinger," or jumper wire, could be removed from the equipment terminal of an insulator. This removal was needed to enable the conductor to be inserted through the wildlife guard. After the "stinger" wire was reconnected to the equipment terminal, the guard was then fitted to the insulator. It should be noted that this unitary type of wildlife guard could not be used where there was a jumper wire between the equipment insulator bushing and an adjacent lightning arrester. Service interruptions are undesirable to both customers and the electrical utility. A service interruption is a nuisance for customers because it has required customers to reset digital clocks and other such devices. For a utility, a service interruption has required that a fused distribution cutout be opened. On systems with linkbreak cutouts this has required that the fuse link be broken and replaced with a new one. On systems with non-linkbreak, non-loadbreak cutouts, it has been necessary for line crew members to use a load breaking device known in the art as a loadbuster tool to interrupt the load. These devices are cumbersome, time consuming and difficult to use. In addition, the loadbuster tools are expensive to purchase and costly to maintain.

Other available wildlife guards have been a two-piece or hinged design. Although the two-piece guards usually did not require service interruptions, the two-piece or hinged guards have required rubber glove handling in order to avoid direct contact with "hot" current-carrying equipment. Further, where guards were applied near a grounded surface, such as a transformer tank, use of insulating rubber blankets was typically required for the safety of line crew members. There was reluctance to install wildlife guards which called for rubber glove handling of "hot" or live equipment due to practical safety concerns. Line crew members, therefore, typically deenergized equipment before installing contemporary wildlife guards, even those guards having a hinged design or a two-piece design.

For substation applications, a prefabricated guard, the "Squirrel Guard" made by the Raychem Corporation exists, but so far as is known, has been limited to installation on deenergized circuits. This type of guard has been fabricated in two main pieces and has had to be fitted and secured to insulators by hand. It was not shotgun stick installable on energized circuits. In addition, this type of existing wildlife guard has used an insulating cover of either a cone-shaped design, a cylindrical design, a cap-shaped design, or some combination or variation thereof over energized conductors. Such designs have been comparatively large because of their need to fit over and enclose an insulator skirt. Consequently, these cover designs have required significant storage space both in warehouses and on line crew trucks before they were installed.

Further, certain wildlife insulator guards for distribution applications have required custom fabrication of guards into a required shape from sheets of insulative material by end users. In particular, end users have been required to cut these sheets by hand to a required shape adapted to fit the particular distribution equipment. So far as is known, all of these types of wildlife guards are of the two-piece design which require hand-on assembly onto the insulator. This normally requires deenergizing the equipment before installation of the wildlife guard assembly. In addition, distribution cutouts, especially cutout arrester combinations, near grounded equipment have been a major source of wildlife outages. So far as is known, no satisfactory wildlife protection is available for distribution cutouts or for arresters mounted on cutouts as part of an assembly known in the art as a cutout-arrester combination.

SUMMARY OF THE INVENTION

Briefly, the present invention provides a new and improved wildlife guard which is easily and safely installable on electrical power distribution equipment. The present invention provides wildlife guards which are intended for use primarily for distribution applications, and other guards which are intended to be used primarily for substation applications. The wildlife guard is a unitary planar disc-shaped wildlife guard having hot stick installation capability. The guard includes a disc of electrically insulating material having a central opening for mounting on an insulator, a cutaway tab-and-ring section of the disc for adapting the disc to a plurality of insulator shapes and core sizes, and at least one installation grip area of the disc for receiving a gripping end portion of a shotgun stick. The guard may include an adaptation section of the disc for adapting the disc to the dimensions of physically associated power equipment. Also, the guard may include a comb section for engaging and holding the disc in place around an insulator.

The wildlife guard of the present invention is a single unit that protects the bushing, the arrester, and the interconnecting wire when the arrester is mounted adjacent to the bushing. Further, the wildlife guard of the present invention is hot stick installable, eliminating the need for a service interruption or rubber glove handling of "hot" equipment. The wildlife guard of the present invention with its disc-shaped design allows for easy and compact storage and its prefabricated design eliminates the need for improvisation and fabrication by end users.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
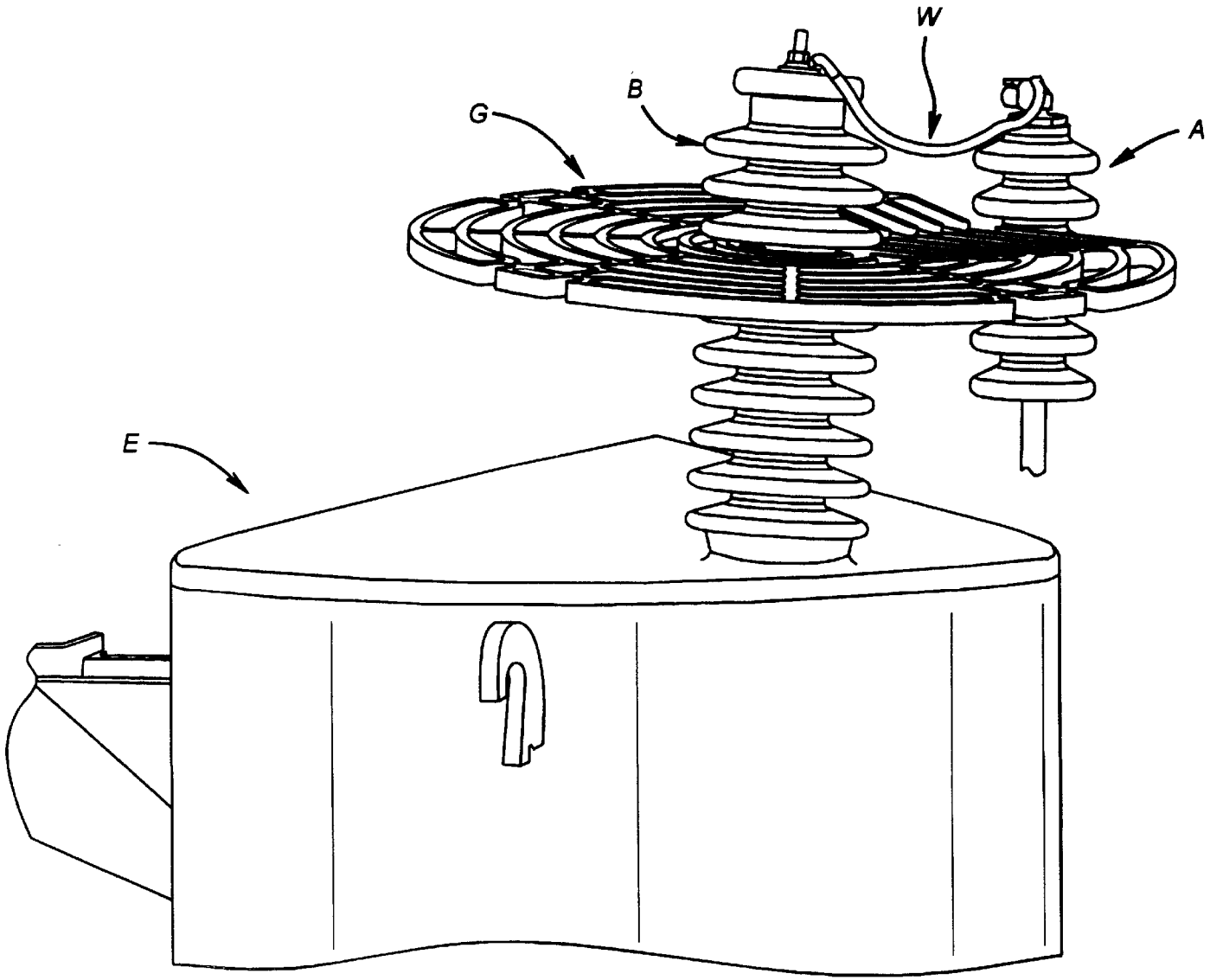
FIG. 1 is an isometric view of a wildlife guard according to the present invention mounted on electrical power distribution equipment.

In the drawings, the letter G designates generally a wildlife guard according to the present invention for installation on electrical power equipment for protection purposes. The guard G is shown in FIG. 1 installed on an insulative bushing B of electrical power equipment E. As will be set forth, the guard G prevents wildlife from coming into contact simultaneously with both an electrically energized portion of the equipment, such as a bushing terminal or a wire W connecting a bushing terminal to an arrester A, and an electrically grounded area or portion of such equipment. In doing so, the guard G protects against short circuits and consequent power outages in an electrical power distribution network.

The guard G also prevents unnecessary death or injury to wildlife. The types of wildlife include smaller animals, such as squirrels and birds. The larger guard G-1 (FIG. 8) protects against larger animals as well. The larger types of wildlife include raccoons, snakes, opossums, raptors and the like. As can be seen in FIG. 1, the guard G is of a size to serve as an outwardly extending barrier so that an animal with one portion of its body, such as feet or paws on an electrically grounded part of the power distribution network is unable to contact an electrically energized portion of electrical power distribution equipment, such as the wire W connecting bushing B and arrester A.

The bushing B is of the conventional type used in both substation applications and in distribution applications. Examples of distribution applications with bushings where the guard G may be used are on transformer cans or tanks, on capacitors, on line arresters, on or near cutouts, reclosers, switches, regulators and the like. Examples of substation equipment with bushings where the guard G may be used include, for example, bus insulators, switch insulators, breakers, surge arresters, fuses and the like. It should be understood that the foregoing examples are given for illustrative purposes, and that other applications of the guard G are evident to those in the art.

Figure 2:
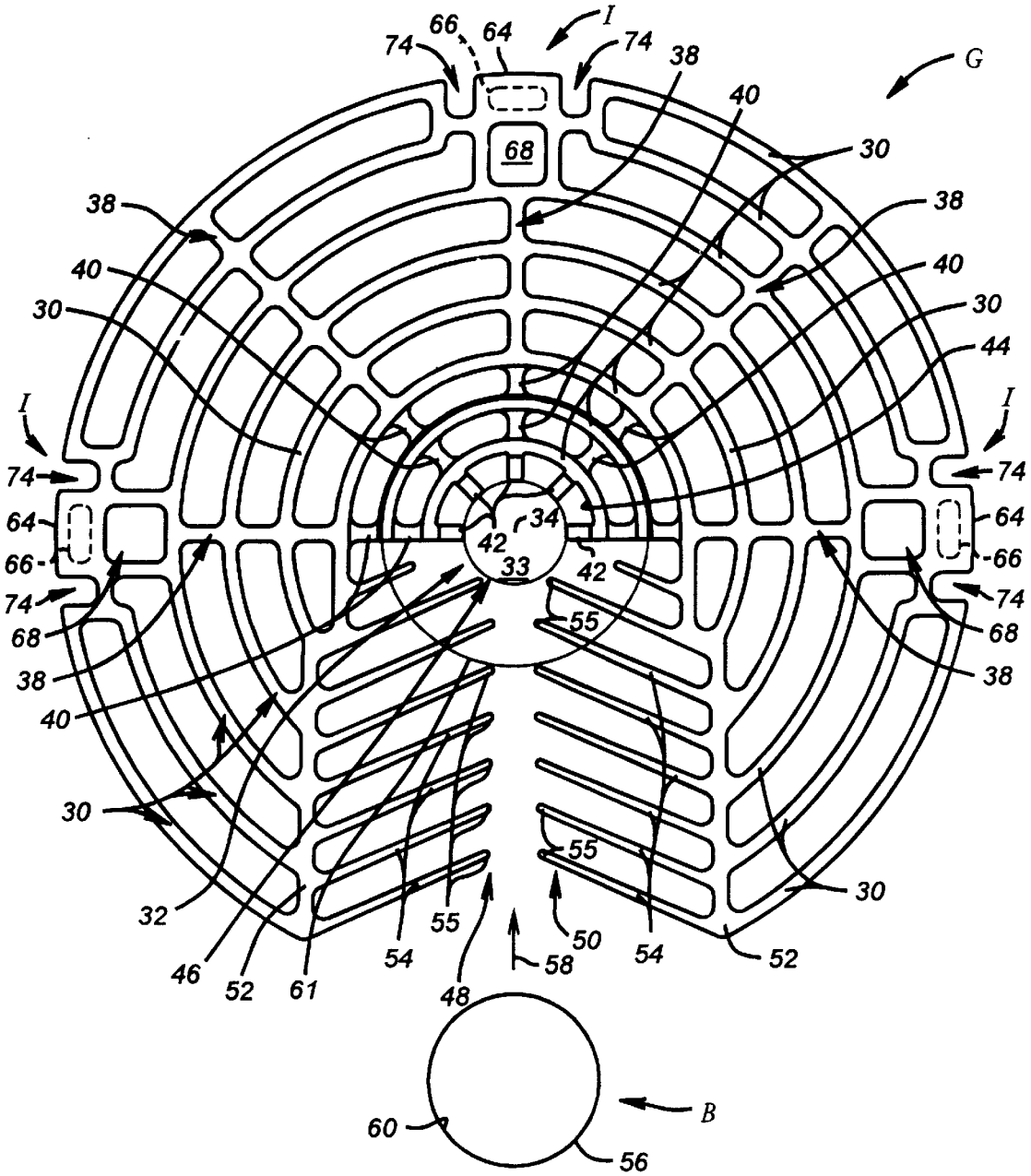
FIG. 2 is a plan view of the wildlife guard of FIG. 1.
Figure 3:
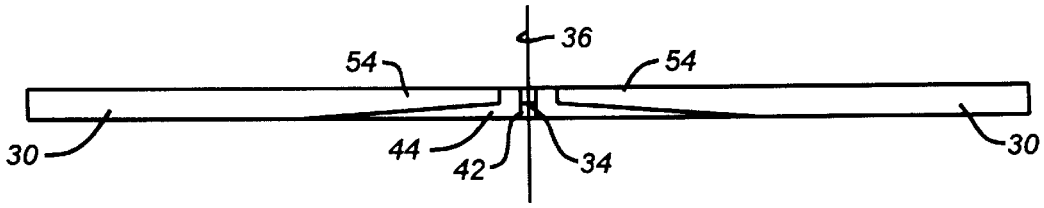
FIG. 3 is a side elevation view of the wildlife guard of FIGS. 1 and 2.
Figure 4:
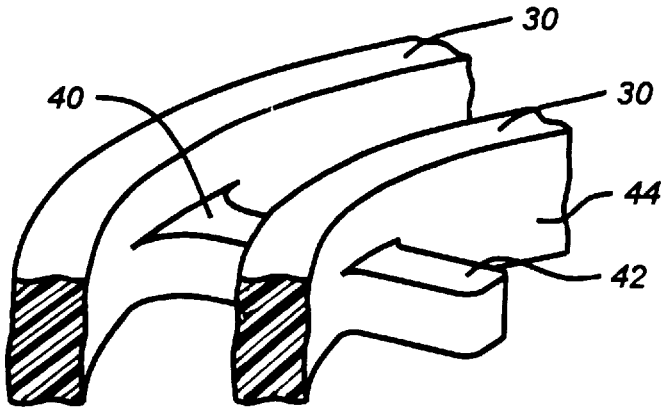
FIG. 4 is an enlarged isometric view of a portion of the wildlife guard of FIG. 2 circled and having reference numeral 4 designating same.

The guard G is preferably formed by being molded of a synthetic resin, such as polypropylene, of a suitable strength. Preferably the guard G is formed of an ultraviolet resistant or UV stabilized thermoplastic material. Turning now to FIG. 2, the guard G is formed of a number of spaced, circular concentric ring members 30 of increasingly greater diameter disposed outwardly from a central section 32 which extends about a central inner opening or mounting slot area 33 about a central point 34. The rings 30 of the guard G are disposed outwardly from the central point 34 about the opening 33. The ring members 30 are typically about one-half inch in vertical height or thickness along a longitudinal axis 36 (FIG. 3) of the central point 34 of the central inner opening, but may be somewhat thicker, such as about ⅝". The rings 30 are also each typically about one-quarter inch or so in width or circular thickness in diametric extent measured from the central point 34. The rings 30 are spaced from each other for reduction of weight and wind loading, and also to allow rain to periodically wash the bushing B or arrester A of debris or dirt.

Each of the spaced ring members 30 beyond the innermost three or so is connected to the adjacent ones of the concentric ring members 30 by a suitable number of radially extending spacer tabs 38 which are angularly separated from each other about the central point 34. The number and angular spacing of the tabs 38 is dependent on the desired degree of strength and load bearing capability of the guard G. In the embodiment shown, the tabs 38 are spaced at 45° radial intervals from each other with respect to the central inner opening 34. Transition surfaces between the tabs 38 and the rings 30 are generally curved or rounded for additional strength and ease of manufacture and molding. The tabs 38 are comparable in lateral width to the thickness of the rings 30 or about one-half to five-eighths inches or so. The innermost three of the ring members 30 are spaced from each other by inner tabs 40 which are generally of reduced height as compared to the rings 30.

The reduced thickness inner tabs 40 are radially aligned with the tabs 38 and are typically about half as thick as the tabs 38. Further a set of inwardly extending lugs 42 are formed on an inner surface 44 of the innermost ring member 30. The lugs 42 are also radially aligned with tabs 38 and 40 and are of comparable thickness to the tabs 40. The inward extent of the lugs 42 defines the initial maximum insulator core diameter as indicated by a circle 46 of the bushing or object which can be fitted into the central opening 34. If desired, the guard G may be adapted for sizing purposes to fit onto larger diameter objects. This is done by cutting away the lugs 42 and one or more of the inner ring members 30. The reduced thickness of inner tabs 40 facilitates this removal for sizing purposes.

The tabs 40 and lugs 42 are preferably of the same shape and of similar function. It is also typical for notches or reduced thickness connector portions to be formed in the tabs 40 at their inner ends where they connect with an inner ring 30. As described below, it is sometimes desirable to remove one or more of the inner rings 30 for sizing purposes. The notches or tabs 40 allow ease of removal of the inner rings 30 at their juncture with an inward end of the tabs 40. This permits the portion of the tab 40 remaining after removal of the ring 30 to function in a like manner to lugs 42.

The guard G has an insertion slot 48 formed extending radially inwardly from an outermost portion 50 adjacent the outermost ring 30 inwardly to the central opening or mounting slot 34. The insertion slot 48 serves as a passage or channel through which a portion of the electrical power equipment passes as the guard G is being mounted or installed.

The insertion slot 48 is formed between two generally parallel inwardly extending ribs or structural members 52 which extend from the outermost ring member 30 to the central opening 34. The guard G includes a plurality of angularly inwardly extending flexible teeth or fingers 54 formed on the rib members 52 on each side of the insertion slot 48. The insertion teeth 54 serve as insertion guides as the guard G is being installed or mounted onto electrical equipment. During such insertion, a portion of the bushing or equipment B, as indicated schematically at 56, is allowed to move inwardly, as indicated by an arrow 58, through the insertion slot 48 from the outermost ring member 30 to the central opening 34. The teeth 54 flex inwardly to allow passage of bushing B or arrester A during insertion of guard G. The flex of teeth 54 also serves to hold the guard G snugly to the bushing B or A.

The lugs 42 are provided to engage an outer surface 60 of the bushing B. As has been set forth, all or portions of the lugs 42, the inner rings 30 and the inner tabs 40 adjacent the central opening 34 out to a region indicated by line 61 may be removed. Removal is usually by cutting in order to allow snug fitting and engagement with the outside diameter 60 of the bushing or other electrical equipment on which the guard G is mounted.

The teeth 54 of the guard G adjacent the insertion slot 48 also serve as restraining members in the event of force being applied to attempt to move the guard G off the equipment. Due to the angular inward extension of the teeth 54, outer end portions 55 of the teeth contact the outer surface 60 of the bushing or equipment and resist outward movement. If required, portions of teeth 54 within region 61 may also be removed to accommodate larger bushings B.

It is to be noted that the inwardly extending teeth or fingers 54 at their innermost portions 55 are spaced from each other a distance less than the outside diameter of the portion 60 of the bushing B or other equipment on which the guard G is to be mounted. This serves to provide an additional restraining force or function against outward movement of the guard member G off of the electrical equipment once it has been installed.

The guard G also includes one or more installation grip areas I formed at suitable locations adjacent outer portions of the guard G. In the embodiment of FIG. 2, three such installation guide areas I are shown, although other numbers could be used, if desired. The installation grip areas I include a base or plate member 64 usually square or rectangular in shape of comparable thickness to the rings 30. If desired for weight or cost reduction purposes, parts of the base member 64 may be of reduced thickness, as indicated by an area within phantom lines 66.

Figure 7:
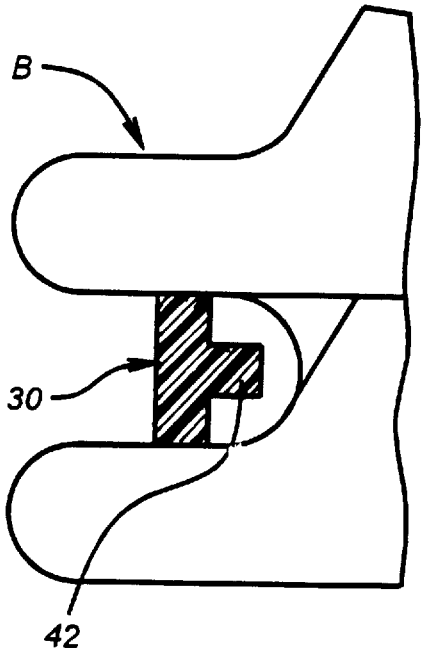
FIG. 7 is an enlarged view of a portion of the wildlife guard of FIG. 2 engaging an insulative bushing.
Figure 5:
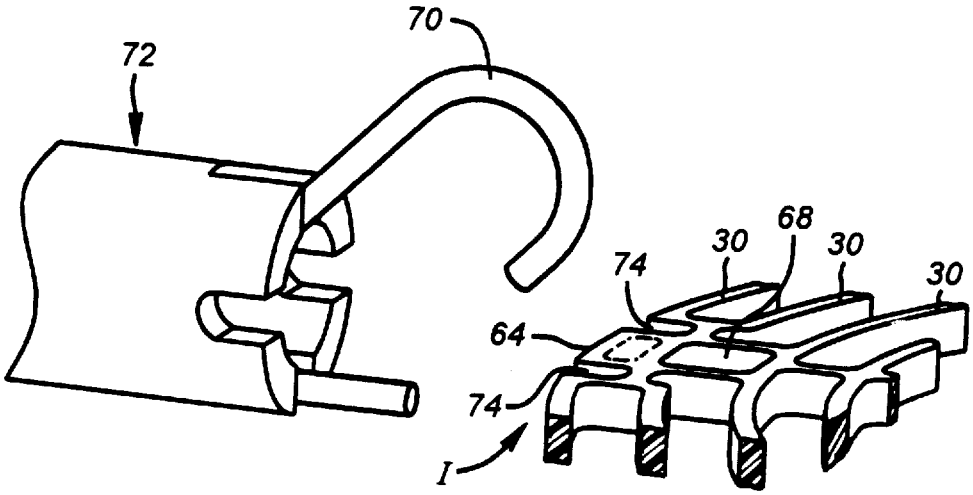
FIGS. 5 and 6 are isometric views of the wildlife guard of FIG. 2 being engaged by an installation tool.
Figure 6:
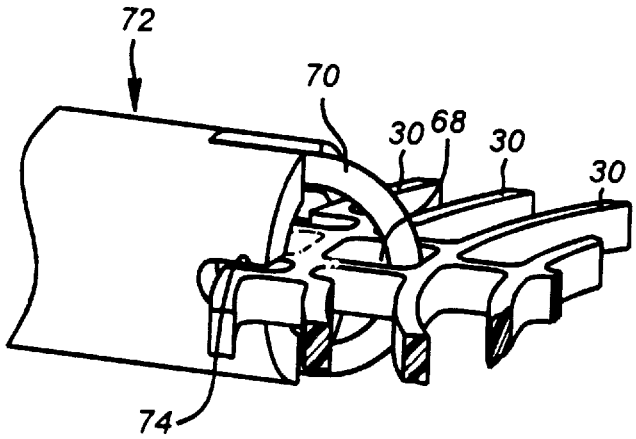

An opening or port 68 is formed in the guard G adjacent to the base member 64 of each of the installation guide or grip areas I. The opening or port 68 serves as a passage to allow connection and passage of a head or hook member 70 of a conventional, lockable electrical power line manipulator working tool 72, known generally in the art as a "shotgun stick." Thus, as is shown in FIGS. 5 and 6, the guard G may be easily grasped and manipulated by a line crew member using the shotgun stick 72. As is evident from the drawings, the port 68 is formed inwardly of the base member 64 for better stability in gripping and for ease in manipulation of the guard G during its installation. A set of inwardly extending guide notches or grooves 74 are also preferably formed in the guard G adjacent each side of the base area 64 for ease of access of the shotgun stick during connection with the guard G. The guide notches 74 also permit the shotgun stick 72 to obtain a firm grip on the guard G during movement and manipulation of the guard G as it is being installed. As is shown in FIG. 7, the ring members 30 are of a size permitting the guard G to be fitted between adjacent skirts of bushing B. In other situations, the tabs 42 and 40 serve as contacts with the outer surface of the bushings B.

Figure 8:
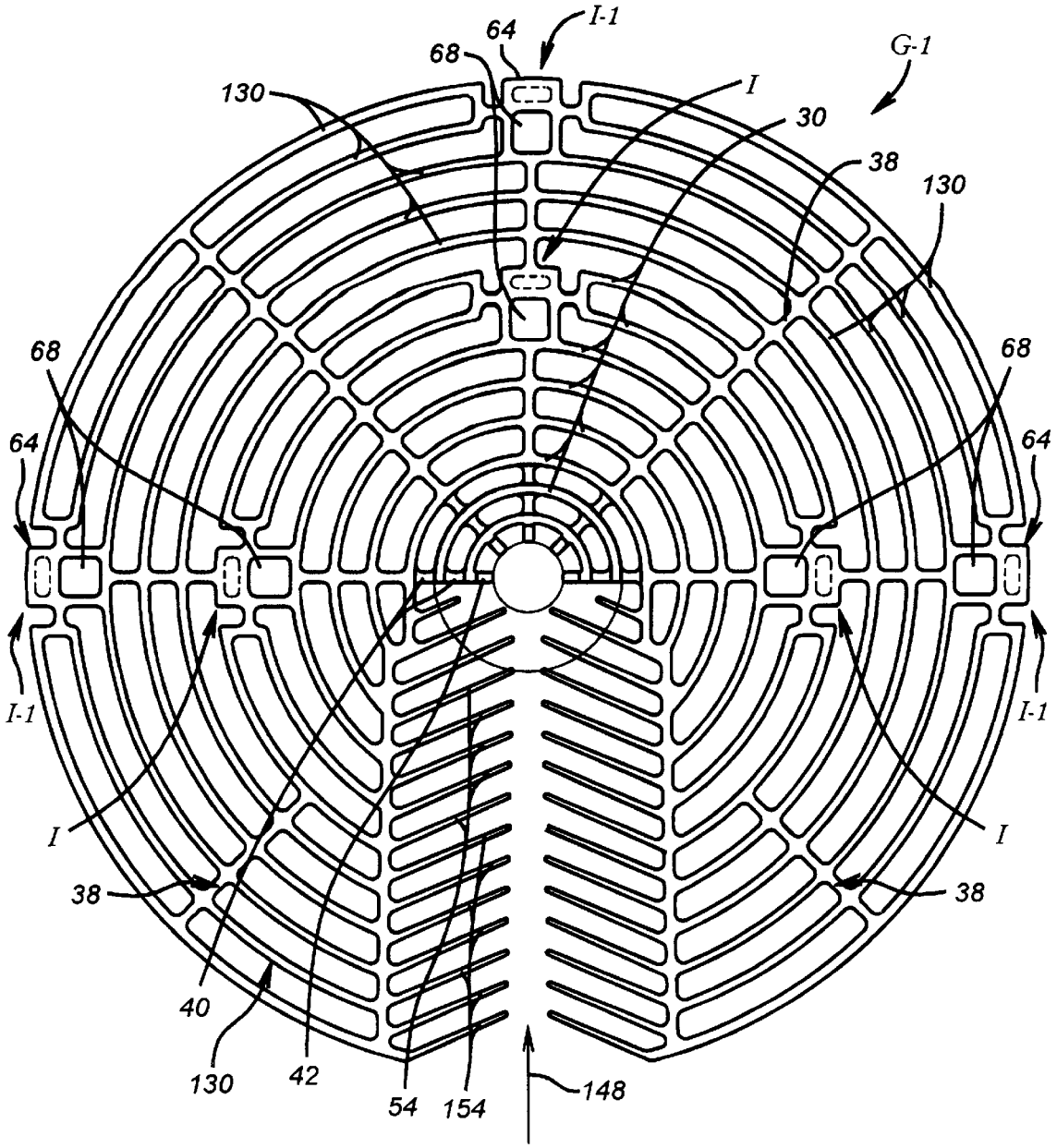
FIG. 8 is a plan view of an alternate, enlarged wildlife guard of the present invention.

It should also be understood that guards G of any suitable outside diameter may be in accordance with installation requirements for electrical power distribution equipment. For example, a guard G-1 of FIG. 8 is of greater outside diameter than the guard G and has an additional four or five outer members or rings 130 as well as additional teeth 154 along an elongated insertion slot 148, as well as a second set of installation grips I-1 further outwardly spaced from the central portion 34. The guard G is especially adapted for situations where spacing between the bushing B and arrester A is such that a single guard G may serve as a barrier for both pieces of equipment. In these situations, the guard G is installed on the bushing B and the arrester A will be in the insertion slot 48, the interconnecting wire W will be above the guard G and thus protected. Otherwise, the guard G is of like structure and function to the guard G and accordingly, like structure in the two guards performing like functions bears like reference numerals.

The guard G can be seen to be a relatively thin, yet strong, easily stackable disc which is easily stored and does not occupy considerable storage space. Further, it is formed of a high-strength, durable synthetic resin which is resistant against deterioration from the sun's ultraviolet rays during service use. The material of the guard G may be dyed a suitable color for possible additional deterrent effects on certain animals. It has been determined that the color red has such an effect in some cases.

To install the guard G, it is easily gripped at one of the installation grips I (FIGS. 5 and 6) by the shotgun stick 72. An initial sizing measurement may be made, so that portions of the lugs 42, inner rings 30 and tabs 40 may be cut away as needed to ensure a proper, firm fitting engagement with the bushing B.

The guard G once properly sized is then again gripped at the grip area I by the shotgun stick 72 and moved so that the insertion slot 48 is aligned with bushing B. There is no need for electric power distribution to be interrupted as this is done. Further the line crew members are spaced from the bushing B and wire W by the length of the shotgun stick 72. The teeth 54 serve as insertion guide, as noted above, and the guard G slides easily into firm engagement onto the portion 56 of the bushing B. When installed, the guard G serves as a protective barrier so that wildlife do not come into simultaneous contact with both a live or electrified wire and an electrically grounded surface or area.

It should be understood that the wildlife guards of the present invention apply to a wide variety, if not all, insulator materials. Further, although the alternative embodiments show the wildlife guards of the present invention for use in protecting bushings, arresters, insulators, and terminators, the present invention contemplates that other power devices having energized and grounded surfaces may also be protected from wildlife. In addition, though the wildlife guards of the present invention are installable on energized power equipment by using live line tools, the guards, of course, may be installed by hand on de-energized power equipment if desired.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

What is claimed is:

1. A wildlife guard for live electrical power equipment to prevent wildlife from simultaneously contacting an electrically energized and an electrically grounded surface, comprising:

a disc of electrically insulating material having a central opening for fitting onto the equipment;

said disc having an insertion slot extending from an outer portion to said central opening for movement of said disc onto the equipment; and said disc having at least one installation grip area for engagement with a gripping portion of an installation tool, said installation grip area comprising:

a plate member for engagement with the gripping portion of the installation tool; and a passage port adjacent to said plate member for passage of the gripping portion of the installation tool.

2. The wildlife guard of claim 1, wherein said disc comprises:

a plurality of ring members concentrically located about the central opening; and spacer ring tab members mounted between said ring members for connecting said ring members.

3. The wildlife guard of claim 2, further including:

a plurality of lug members extending inwardly into said central opening from an inner one of said ring members for engaging an outer surface of the equipment.

4. The wildlife guard of claim 2, wherein said ring members are of increasing diameter extending in concentric location from an innermost ring member adjacent said central opening to an outermost ring member.

5. The wildlife guard of claim 2, wherein:

inner ones of said ring members are removable from said tab members.

6. The wildlife guard of claim 5, wherein said tab members adjacent said inner ones of said ring members function as engaging lugs on removal of said inner ones of said ring members.

7. The wildlife guard of claim 1, further including guide notches formed in said disc adjacent said installation grip for engagement with the installation tool.

8. The wildlife guard of claim 1, further comprising:

a plurality of teeth formed along said insertion slot engaging the equipment and holding said disc in place on the equipment.

9. The wildlife guard of claim 8, wherein said teeth face inwardly along side portion of said insertion slot to allow ease of movement of said disc onto the equipment.

10. The wildlife guard of claim 8, wherein portions of said teeth are removable to adapt said disc for various sizes of electrical power distribution equipment.

11. The wildlife guard of claim 1, wherein said disc comprises a barrier between an energized surface and a grounded surface.

12. The wildlife guard of claim 1, further comprising:

said disc having a plurality of installation grip areas formed therein for engagement with a gripping portion of an installation tool.

13. The wildlife guard of claim 1, wherein said passage port is formed inwardly of said plate member on said disc with respect to said central opening.

14. A wildlife guard for protecting wildlife from simultaneous contact between energized and grounded areas in electrical power distribution equipment, comprising:

a disc of electrically insulating material having a central opening for fitting onto the equipment;

said disc extending outwardly from the equipment to serve as an access barrier between the energized and grounded areas;

said disc having an insertion slot extending from an outer portion to said central opening for movement of said disc onto the equipment; and said disc having at least one installation grip area for engagement with a gripping portion of an installation tool, said installation area comprising.

a plate member for engagement with the gripping portion of the installation tool; and a passage port adjacent to said plate member for passage of the gripping portion of the installation tool.

15. A method of installing a wildlife guard having an installation grip onto a skirted insulator in electrical power equipment without interrupting electrical power service, comprising the steps of; gripping a portion of a plate member of an installation grip of the wildlife guard with an insulated line working tool; moving the guard to a position adjacent the insulator; aligning a slotted portion of the guard with the insulator; and moving the guard along its slotted portion onto the insulator.

16. The method of claim 15, wherein the electrical power equipment comprises substation equipment.

17. The method of claim 15, wherein the electrical power equipment comprises distribution equipment.

18. The method of claim 15, further including the step of:

adjusting the size of the guard to fit onto and engage the skirted insulator.

19. A wildlife guard for protecting wildlife from simultaneous contact between energized and grounded areas in electrical power distribution equipment, comprising:

a disc of electrically insulating material having a central opening for fitting onto the equipment;

said disc extending outwardly from the equipment to serve as an access barrier between the energized and grounded areas;

said disc having an insertion slot extending from an outer portion to said central opening for movement of said disc onto the equipment; and a plurality of teeth formed along said insertion slot engaging the equipment and holding said disc in place on the equipment.

20. The wildlife guard of claim 19, wherein said teeth face inwardly along side portion of said insertion slot to allow ease of movement of said disc onto the equipment.

21. The wildlife guard of claim 19, wherein said disc comprises:

a plurality of ring members concentrically located about the central opening; and spacer ring tab members mounted between said ring members for connecting said ring members.

22. The wildlife guard of claim 21, wherein said concentrically located ring members are spaced from each other.

23. The wildlife guard of claim 19, further including:

a plurality of lug members extending inwardly into said central opening from an inner one of said ring members for engaging an outer surface of the equipment.

24. The wildlife guard of claim 19, wherein said ring members are of increasing diameter extending in concentric location from an innermost ring member adjacent said central opening to an outermost ring member.

25. A wildlife guard for protecting wildlife from simultaneous contact between energized and grounded areas in electrical power distribution equipment, comprising:

a disc of electrically insulating material having a central opening for fitting onto the equipment;

said disc comprising:

a plurality of ring members concentrically located about the central opening; and spacer ring tab members mounted between said ring members for connecting said ring members.

said disc extending outwardly from the equipment to serve as an access barrier between the energized and grounded areas; and said disc having an insertion slot extending from an outer portion to said central opening for movement of said disc onto the equipment.

26. The wildlife guard of claim 25, wherein said concentrically located ring members are spaced from each other.

27. The wildlife guard of claim 25, further including:

a plurality of lug members extending inwardly into said central opening from an inner one of said ring members for engaging an outer surface of the equipment.

28. The wildlife guard of claim 25, wherein said ring members are of increasing diameter extending in concentric location from an innermost ring member adjacent said central opening to an outermost ring member.

29. The wildlife guard of claim 25, further comprising:

a plurality of teeth formed along said insertion slot engaging the equipment and holding said disc in place on the equipment.

30. The wildlife guard of claim 29, wherein said plurality of teeth face inwardly along side portions of said insertion slot to allow ease of movement of said disc onto the equipment.

* * * * *